US006475024B1

(12) United States Patent
Narui

(10) Patent No.: US 6,475,024 B1
(45) Date of Patent: Nov. 5, 2002

(54) CABLE CONNECTOR

(75) Inventor: Fumio Narui, Tokyo (JP)

(73) Assignee: Kel Corporation, Tokyo (JP)

( * ) Notice: Subject to any disclaimer, the term of this patent is extended or adjusted under 35 U.S.C. 154(b) by 0 days.

(21) Appl. No.: 09/711,698

(22) Filed: Nov. 13, 2000

(30) Foreign Application Priority Data

Nov. 17, 1999 (JP) ..... 11-326888

(51) Int. Cl.[7] ..... H01R 12/24
(52) U.S. Cl. ..... 439/495; 439/497
(58) Field of Search ..... 439/495, 497, 439/579, 67, 77

(56) References Cited

U.S. PATENT DOCUMENTS 4,352,531 A * 10/1982 Gutter ..... 439/497
4,437,723 A * 3/1984 Narozny ..... 439/404
4,619,487 A * 10/1986 Brush, Jr. ..... 439/98
4,687,263 A * 8/1987 Cosmos et al. ..... 439/108
4,971,574 A * 11/1990 Garcia ..... 439/497
5,044,963 A * 9/1991 Kukkonen et al. ..... 439/55
5,194,010 A * 3/1993 Dambach et al. ..... 439/79
6,123,582 A * 9/2000 Ko et al. ..... 439/579
6,139,363 A * 10/2000 Ko et al. ..... 439/579
6,183,281 B1 * 2/2001 Wu et al. ..... 439/260

* cited by examiner

*Primary Examiner*—Brian Sircus
*Assistant Examiner*—Hae Moon Hyeon
(74) *Attorney, Agent, or Firm*—Robert W. J. Usher

(57) ABSTRACT

A cable connector comprises a plurality of female contacts 20 which are arrayed and held in a lateral direction inside an insulating housing 10, and a cable consisting of a plurality of conductors, the front ends of which are connected to said contacts and the rear ends of which extend externally from said housing. Here, the cable consisting of a plurality of conductors is an FPC cable 50 wherein a plurality of signal conducting layers 51 are formed on one face thereof and a ground conducting layer is formed on the other face thereof. The cable connector is constituted by connecting the signal circuit layers 51 to the plurality of female contacts 20, and connecting the ground conducting layer 55 to the shield cover 30 in the housing.

9 Claims, 19 Drawing Sheets

CABLE CONNECTOR

FIELD OF THE INVENTION

The present invention relates to a cable connector having a composition wherein contacts are arrayed and held in a lateral alignment within a housing, a cable having one end connected to the contacts extending outside the housing.

BACKGROUND OF THE INVENTION

Multiple pole cable connectors of the kind described above are commonly used at present: for example, cable connectors using flat cables are commonly used for connecting circuit boards, or the like. In recent years, a demand has emerged for cable connectors for high-frequency communications, connecting circuit boards contained in a personal computer, or connecting between a liquid crystal display panel and a processing unit, and as cable connectors for communications of this kind, cable connectors using AWG40 ultra-fine coaxial cables have been proposed. These coaxial cables have excellent high-speed transmission characteristics, and although provided with a shield layer, they are extremely thin, having a outer skin diameter of approximately 0.35 mm, as well as excellent durability with respect to bending. Therefore, it is thought that communications cable connectors using such cables will become widespread in the future.

However, this type of cable connector entails problems in that, since the cables have an ultra-fine coaxial wire structure, the material cost comprised in the cable is high, and moreover, since a sub-assembly process is required to peel off the cable covering into two stages, namely, the shield layer and the core wire, the wiring cost is also high, thereby making the overall cost of the cable connector expensive.

On the other hand, it is not uncommon to encounter a use situation where the electrical properties provided by coaxial cables are not required, but where properties equivalent to those of a cable connector using the aforementioned ultra-fine coaxial cables are required with regard to wiring space and bending tolerance. In other words, there is a demand for a compact, light-weight cable connector having excellent mechanical properties, which can be produced at low cost.

SUMMARY OF THE INVENTION

It is an object of the present invention to provide a cable connector, which is compact and light-weight and has excellent mechanical properties, similarly to a cable connector using ultra-fine coaxial cables, and which can be produced at low cost.

In order to achieve the aforementioned objects, in the present invention, a plurality of contacts (for example, female contact 20, plug contact 140) are arrayed and held in a lateral direction inside a housing, (for example, insulating housing 10, plug holding member 110) a cable is provided, the front end of which is connected to the contacts and the rear side of which extend externally from the housing, and shield covers (for example, a shield cover 30, upper cover 120 and lower cover 130) are provided on the housing, covering the outer side of the contacts. The cable is a FPC (Flexible Print Circuit) cable wherein a plurality of signal conducting layers are formed. This cable is fabricated by forming a plurality of signal conducting layers (for example, signal circuit layers 51) onto one surface of a sheet member (film member) made from an insulating material, and forming a ground conducting layer, (for example, ground circuit layer 53) onto the other surface thereof. The ground conducting layer is connected to the shield covers and the plurality of signal conducting layers are respectively connected to a corresponding one of the plurality of contacts.

In a cable connector of this kind, since a composition is adopted where an FPC cable is used as a cable for transmitting information to the respective contacts, it is possible to provide, at low cost, a cable connector which is compact and light-weight and has good bending durability, similarly to a case where ultra-fine coaxial cables are used. Since a ground conducting layer for connecting to the shield covers is provided in this FPC cable, it is possible to provide a cable connector having good electrical transmission properties compared to a flat cable, or the like, which does not have shield layer. If a multiple layer composition is used for the FPC cable and ground conducting layers are formed on either side of the signal conducting layers, then it is possible to obtain an FPC cable connector having electrical transmission properties equivalent to those obtained using a shielded cable.

Preferably, the ground conducting layer in the FPC cable is formed on the outer side of the housing from the electrical connecting section between the signal conducting layers and the contacts. By adopting a composition of this kind, no ground conducting layer is formed on the connecting section where the signal conducting layers are connected to the contacts, or on the rear face thereof, and hence the insulating properties between the signal conducting layers and the ground conducting layers can be improved. Moreover, since it is possible to prevent heat from escaping via the ground conducting layer when bonding the signal conducting layers using a heater tool, a cable connector with good bonding characteristics can be obtained.

For the. FPC cable in the vicinity of the connecting section between the signal conducting layers and the contacts, the flat end section may be used unaltered, but it may also be formed in such a manner that the plurality of signal conducting layers are respectively separated into individual band shapes (for example, see signal circuit connecting end sections 51*a* illustrated in the present embodiment.) If a composition of this kind, for example, a composition wherein a slit or a U-shaped cut is provided between the respective signal conducting layers is adopted, then even if there is some variation in the installation height of the contacts in the housing, or if they are inclined, then it is possible to make the respective connecting sections separated into band shapes correspond to the respective contacts. Moreover, even in cases where a housing structure is adopted having walls which provide separation between adjacently positioned contacts, it is possible to make the cable correspond accordingly.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE PREFERRED EMBODIMENTS

Figure 1:
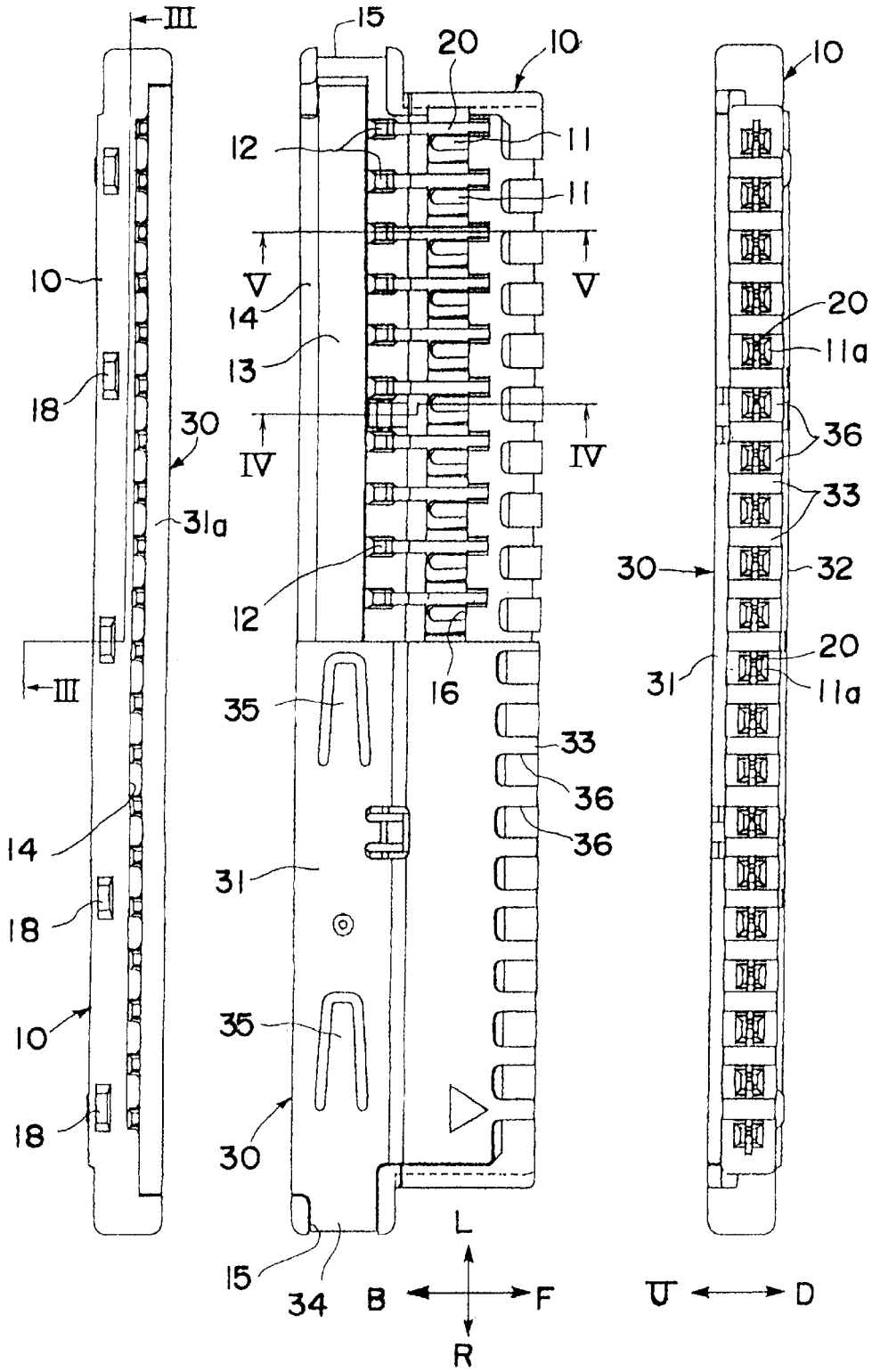
FIGS. 1(A)–(C) are a rear side view, plan view and front view showing a first preferred embodiment of a cable connector relating to the present invention.
Figure 2:
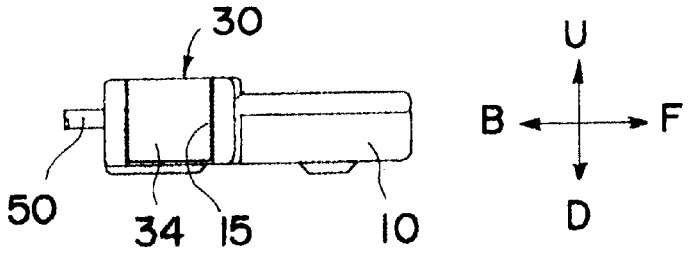
FIG. 2 is a side view of the aforementioned cable connector.

FIG. 1 and FIG. 2 illustrate a preferred embodiment of a cable connector relating to the present invention. This connector is constituted by arranging and holding a plurality of female contacts 20 in a lateral direction (vertical direction in FIG. 1) within a housing 10 made from an insulating material, a shield cover 30 being installed covering the outer face of the insulating housing 10. In order to simplify the description, hereinafter, the rightward direction in FIG. 1(B) is called the forward (F) direction, the leftward direction is called the backward (B) direction, the upward direction is called the leftward direction (L), and the downward direction is called the rightward (R) direction, whilst in FIG. 1(C), the rightward direction is called the downward (D) direction and the leftward direction is called the upward (U) direction.

In FIG. 1(B), in order to illustrate the internal shape of the insulating housing 10, a half cut is shown in one lateral side of the shield cover 30, but the shield cover 30 is formed in such a manner that it covers the whole surface of the insulating housing. Moreover, FIG. 1 depicts a state where the FPC cable 50 is detached, but in practice, the FPC cable is incorporated when forming the cable connector.

Figure 3:
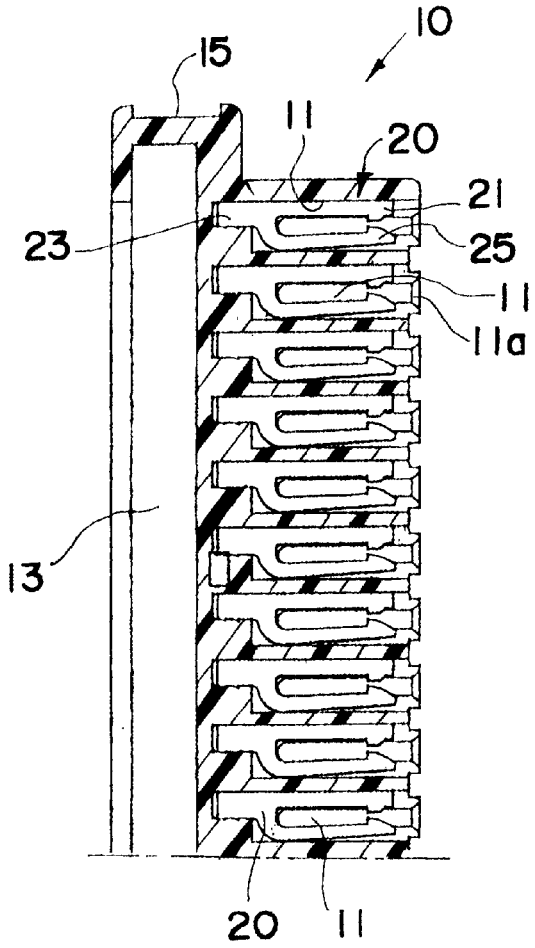
FIG. 3 is a sectional view of the aforementioned cable connector in the direction of arrows III—III in FIG. 1.

As shown in FIG. 3, the insulating housing 10 is formed with a multiplicity of contact insertion spaces 11 aligned in the lateral direction. Each contact insertion space 11 has an insertion opening 11*a* which opens to the forward side, and female contacts 20 are inserted and held via the respective insertion openings 11*a*. As clearly revealed in FIG. 3 to FIG. 10, the female contacts 20 are made by forming a metallic strip material into an approximate Y shape comprising a base section 21, pressure insertion section 23 and elastic arm section 25. This shape is a so-called tuning fork shape, the base section 21 and elastic arm section 25 corresponding to left and right-hand forks, and the pressure insertion section 23 corresponding to a gripping section.

As described above, in a state where the female contacts 20 have been inserted respectively into the contact insertion spaces 11 via the insertion openings 11*a*, the pressure insertion section 23 and base section 21 are pressed into and fixed securely inside the insulating housing 10, whilst the elastic arm section 25 assumes a free state inside the contact insertion space 11. Therefore, the elastic arm section 25 is capable of elastic deformation as illustrated by arrow Al in FIG. 10, inside the contact insertion space 11. Moreover, as revealed by FIG. 3, the female contacts 20 are aligned in a single plane, in such a manner the flat sections thereof extend in the lateral direction, whilst the vertical direction thereof corresponds to the direction of the thickness of the strip.

Figure 4:
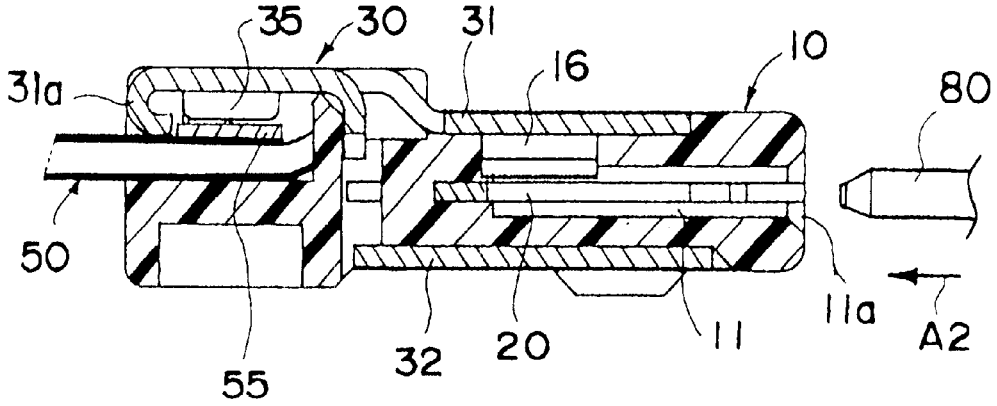
FIG. 4 is a sectional view of the aforementioned cable connector in the direction of arrows IV—IV in FIG. 1.
Figure 5:
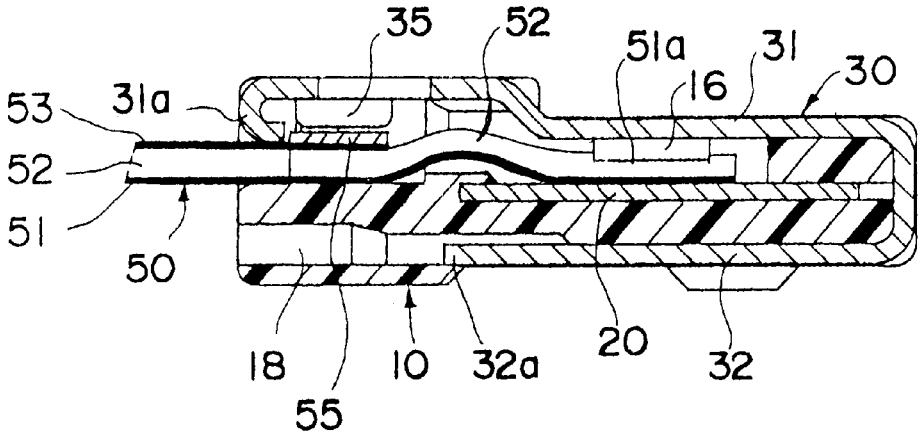
FIG. 5 is a sectional view of the aforementioned cable connector in the direction of arrows V—V in FIG. 1.

On the other hand, in the insulating housing 10, the rear section side of each contact insertion space 11 is open and a single front central groove 16 extending in the lateral direction is formed in the upper portion of this open section (see FIG. 4 and FIG. 5). Moreover, a plurality of signal layer supporting grooves 12 are formed to the rear of this open section at positions approximately matching the base sections 21 of the female contacts 20, these signal layer supporting grooves 12 being aligned in the lateral direction and being open in the upward direction. A single rear central groove 13 which is open in the upward direction is formed extending in the lateral direction to the rear of the signal layer supporting grooves 12. Moreover, a single FPC supporting groove 14 which is open in the upward direction is formed extending in the lateral direction to the rear of the rear central groove 13. Cover engaging grooves 15 are formed respectively on the rear-side left and right-hand end portions of the insulating housing 10, and a plurality of through holes 18 are formed passing in a front/back direction in the lower rear section of the insulating housing 10.

Figure 6:
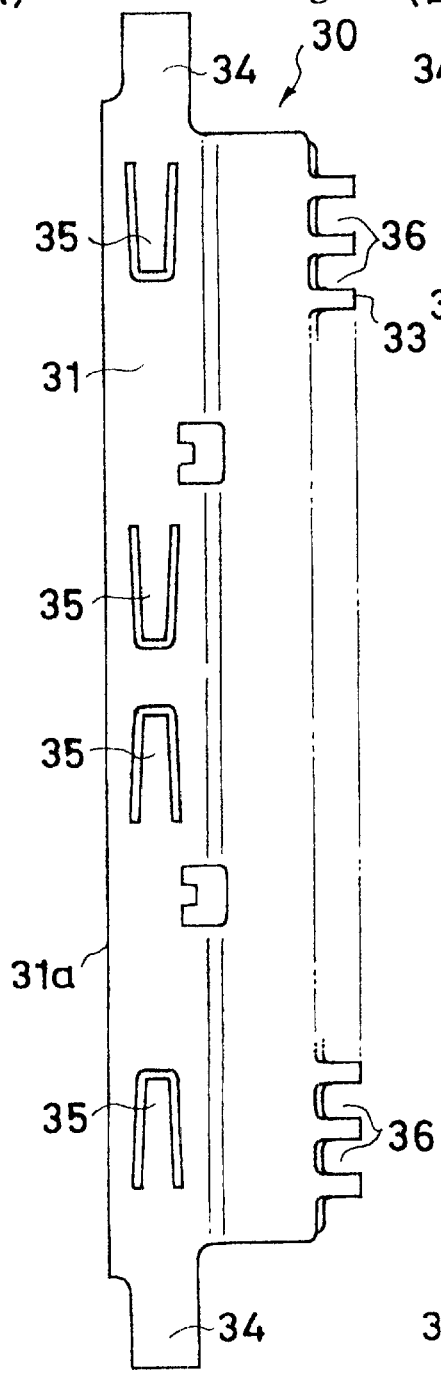
FIGS. 6(A)–(C) is a plan view, front view and side view of a shield cover forming part of the aforementioned cable connector.
Figure 6:
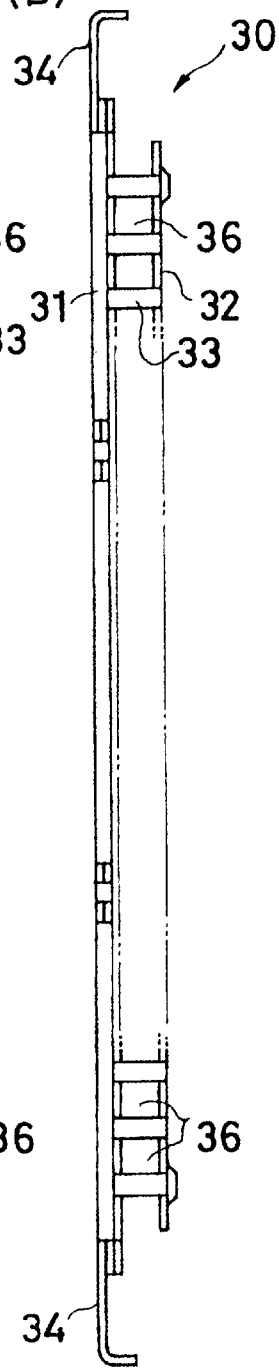
Figure 6:
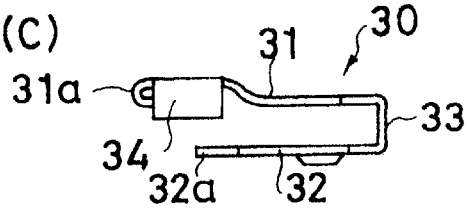

A shield cover 30 which is attached to the outer face of the insulating housing 10 is shown in FIG. 6. As shown in FIG. 6(C), the shield cover 30 is formed by bending a metallic plate material into a U-shaped cross-section, and it comprises an upper cover face 31, a lower cover face 32, and a bend section 33. A multiplicity of connection openings 36 are formed in a lateral arrangement, in the bend section 33. The left and right-hand end portions of the upper cover face 31 extend in a sideways direction, to provide engaging arm sections 34. In four locations in the upper cover face 31, contact tongue strips 35 are formed by cutaways, these contact tongue strips 35 projecting obliquely from the lower face side by being bent obliquely downwards. Furthermore, the rear end portion of the upper cover face 31 is folded back on the inner side in a cross-sectional U shape, thereby forming a fold back section 31*a* and hence increasing the rigidity of the upper cover face 31.

Figure 7:
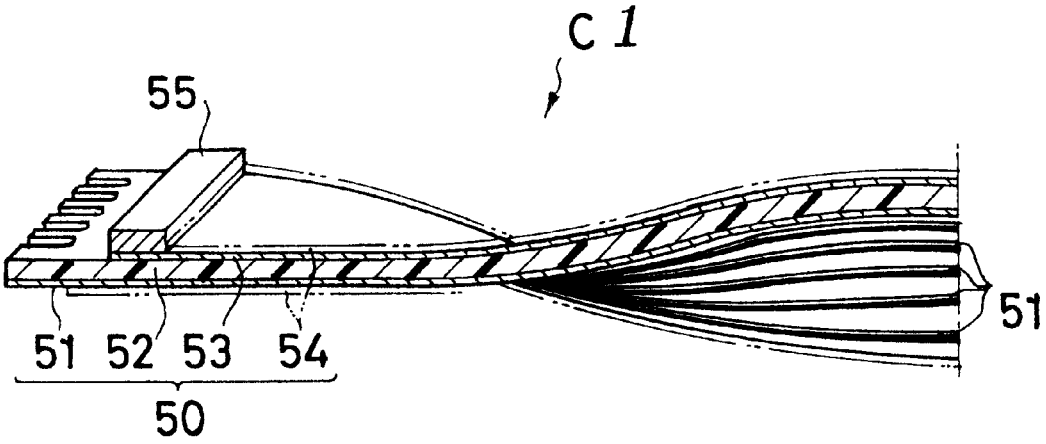
FIG. 7 is an oblique view showing an FPC cable forming part of the aforementioned cable connector.
Figure 8:
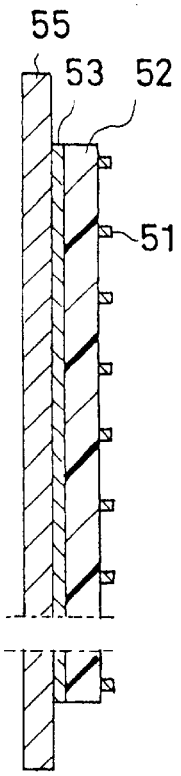
FIGS. 8(A)–(C) is a plan view, rear sectional view and side sectional view showing an FPC cable assembly forming part of the aforementioned cable connector.
Figure 8:
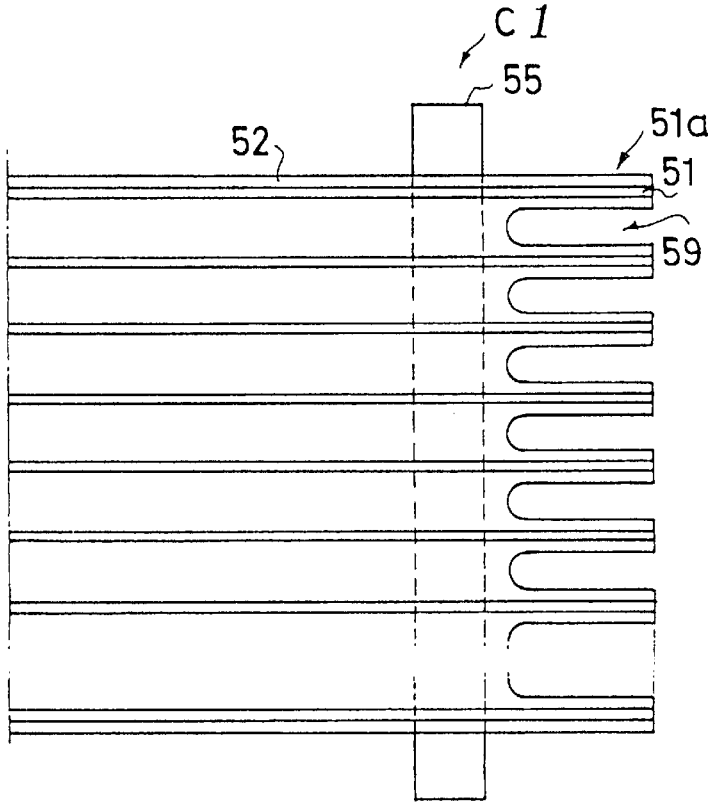
Figure 8:
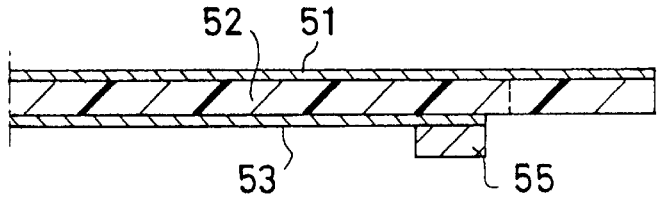

FIG. 7 shows a cable assembly C1 constituting a cable connector which is connected to female contacts 20 held in an insulating housing 10. The cable assembly C1 comprises a flexible FPC cable 50 formed in a flat belt shape, and a ground bar 55 attached in the region of the end of this FPC cable 50.

The FPC cable 50 is constituted by taking a film member made of a thermally resistant insulating resin material, such as polyimide resin, as a circuit substrate 52, forming a signal layer consisting of a plurality of signal circuits 51 on one face (the lower face) thereof, and forming a ground circuit layer 53 on the other face (upper face) thereof, by means of etching, or the like, and forming an insulating layer 54 as a protective coating onto the surface of the respective layers, as necessary, in the regions other than the electrical connecting regions thereof. FIG. 8(A) shows a state where the front end section of an FPC cable 50 is viewed from the side of the lower face, wherein signal lines are constituted by a plurality of signal circuits (signal conducting layers) 51, 51 . . . extending linearly in the forward/backward direction. U-shaped grooves 59, 59, . . . separating adjacently positioned signal circuits are formed in the front end section of the FPC cable 50, and independent band-shaped contact end sections 51*a*, 51*a*, . . . are formed for the respective signal circuits 51, 51, . . . The pitch between the respective signal circuits 51, 51, . . . is the same as the alignment pitch of the female contacts 20 in the insulating housing 10.

On the opposite side of the circuit substrate 52 from the signal circuits (namely the upper face), a ground circuit layer 53 is formed over the entire surface, with the exception of the band shape contact end section (first connecting section), and, in a second connecting section a ground bar 55 made of an electrically conductive material is joined by soldering to the base sections of the U-shaped grooves 59.

The assembly of a cable connector constituted by the foregoing constituent elements is now described with reference to FIG. 4 and FIG. 5. Firstly, as stated above, a multiplicity of female contacts 20 are inserted into the contact insertion spaces 11 via the insertion openings 11*a* in the front face of the insulating housing 10, and are held in an array therein. In this state, the pressure insertion sections 23 and base section 21 are pressed into the insulating housing 10, thereby securing them therein, whilst the elastic arm sections 25 are capable of elastic deformation within the contact insertion space 11, as indicated by arrow A1 in FIG. 10.

Figure 9:
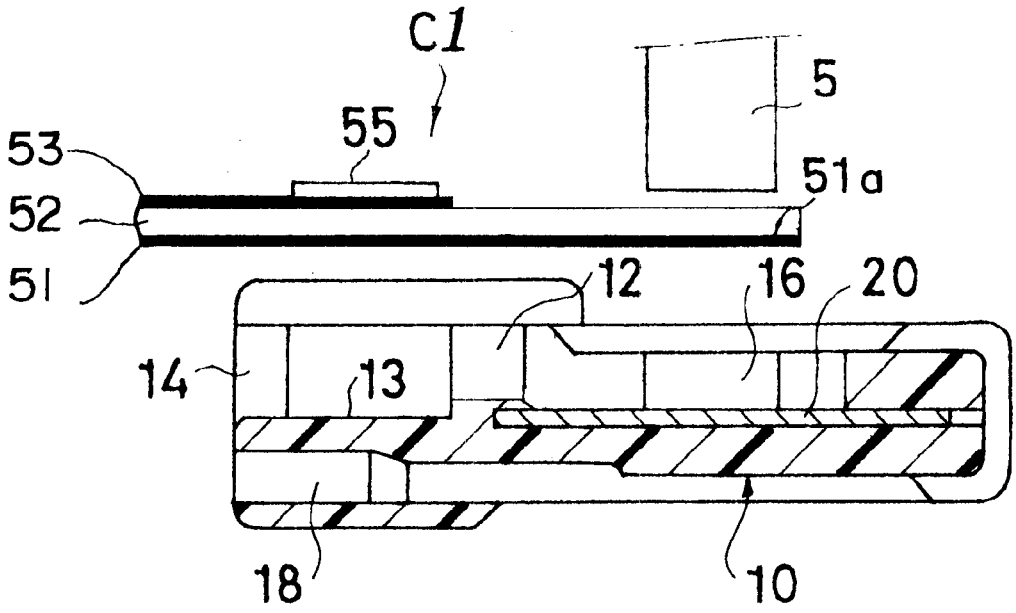
FIG. 9 is an illustrative diagram showing steps for incorporating the aforementioned cable assembly.
Figure 10:
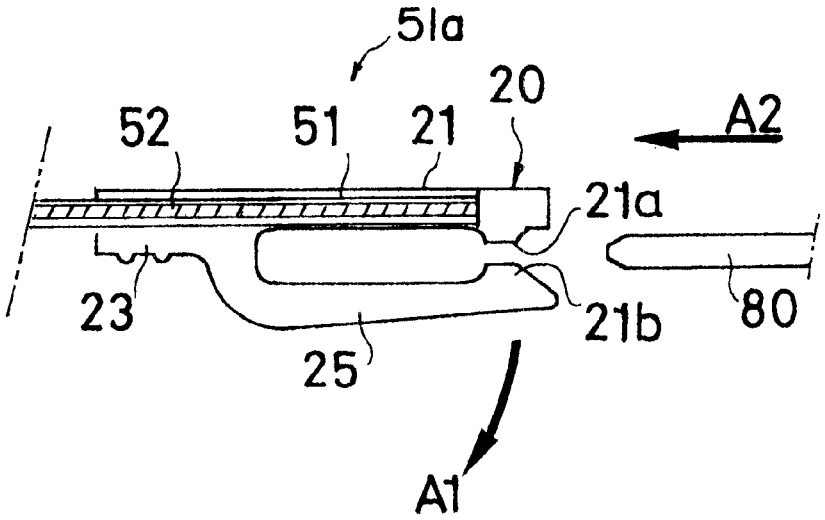
FIG. 10 is a plan view showing female contacts constituting the aforementioned cable connector and male contacts which engage with these female contacts.

In this state, the cable assembly C1 is installed from above as illustrated in FIG. 9. Here, the connection end sections 51*a* of the signal circuits 51 in the FPC cable 50 are installed on top of the base sections 21 of the female contacts 20, as illustrated in FIG. 10, the base sections of these connection end sections 51*a* entering inside the signal layer supporting grooves 12, and the ground bar 55 entering inside the rear centre groove 13. Next, a heater chip 5 of a pulse heater is inserted into the front centre groove 16 and pressed against the multiplicity of connection end sections 51*a* mounted on the respective contact base sections 21, thereby heating same universally from the rear side thereof. A solder coating is previously formed on the connection end sections of the signal circuit layer 51, and this solder is caused to melt by the heat generated by the heater chip 5, thereby soldering the signal circuits 51 to the base sections of respective corresponding female contacts 20, universally, in a single processing step.

Figure 11:
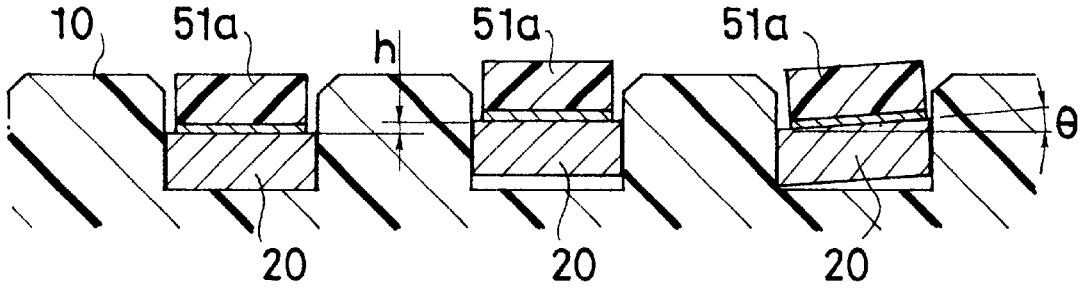
FIG. 11 is an illustrative diagram showing a connected state of the aforementioned cable connector and the female contacts.

Since the connection end sections 51*a* of the FPC cable are formed in respectively independent narrow band shapes, as described above, then flexibility is provided whereby, even if there is a step difference h between the installation heights of the individual female contacts 20, and the installation angle is inclined by an angle of θ from the horizontal, as illustrated by the connection state between the female contacts 20 and connection end sections 51 in FIG. 11, the connection end sections 51*a* are able to deform elastically for coupling in accordance with their respective connection surfaces. Moreover, by adopting an individual composition for the connection end sections in this manner, it is possible to use the same housing as that for an ultra-fine coaxial cable as described in the prior art section above, and hence a cable connector can be provided inexpensively whilst maintaining compatibility. In cases such as the present embodiment where no signal layer supporting grooves 12 are provided, or where the height of the partitions mutually separating the female contacts 20 is low, a composition may be adopted wherein slits (cuts) are inserted between the respective signal circuits, in place of the U-shaped grooves 59, and the respective signal end sections are formed as band-shaped members, in which case similar merits to the foregoing description can be obtained.

Thereupon, the shield cover 30 is installed onto the insulating housing 10 from the front side, in such a manner that the side comprising the U-shaped openings confronts the front face of the insulating housing 10. Here, a plurality of rearward facing projections 32*a* are formed in the rear end of the lower cover face 32 of the shield cover 30, and when the shield cover 30 is installed in the foregoing manner, these projections 32*a* enter into and engage with the through holes 18 of the insulating housing 10 (see FIG. 5). Moreover, the connection openings 36 formed in the front portion of the shield cover 30 respectively oppose the front side insertion openings 11*a*, and hence the insertion openings 11*a* are open to the front side of the assembly, by means of the connection openings 36.

When a shield cover 30 is installed on the insulating housing 10 in this manner, the upper cover face 31 and the lower cover face 32 cover the upper and lower outer faces of the insulating shield 10, and moreover, the bend section 33 covers the front face of the insulating shield 10. In this case, the engaging arm sections 34 at the left and right-hand ends of the shield cover 30 are positioned above the cover engaging grooves 15 in the insulating shield 10, and these engaging arm sections 34 are bent downwards to engage with the insulating shield 10 in such a manner that they cover the cover engaging grooves 15. Consequently, the shield cover 30 is fixed securely to the insulating shield 10. Moreover, in a state where the shield cover 30 is installed in this manner, the contact tongue strips 35 formed in the upper cover face 31 abuts against the ground bar 55, thereby causing the ground circuit layer 53 in the FPC cable 50 to make electrical connection with the shield cover 30.

When a cable connector fabricated as described above is coupled with another connector, the shield cover 30 confronts and contacts with a grounded shield member of the other connector, thereby grounding same. Accordingly, a shielding action is performed by the shield cover 30 and hence any infiltration of external noise or dissipation of noise to external devices can be prevented by the shield cover.

In the foregoing description, the ground bar 55 was described as being provided on one side of the FPC cable 50, but it is also possible to constitute a ground bar 55 which is positioned above and below the FPC cable 50, by first providing an insulating layer on the upper face of the signal circuit layer 51 (for example, a protective coating layer 54 as illustrated in FIG. 7), and then installing a ground bar 55 on top of this insulating coating layer. Moreover, by adopting a composition wherein the FPC cable has a multiple layer structure and a further ground circuit layer is provided via an insulating layer on top of the aforementioned signal circuit layers 51, it is possible to provide ground circuit layers both above and below the signal circuit layers 51. By adopting this composition, similar effects are obtained to a case using a shielded cable which shields infiltration of external noise and outward dissipation of noise.

Figure 12:
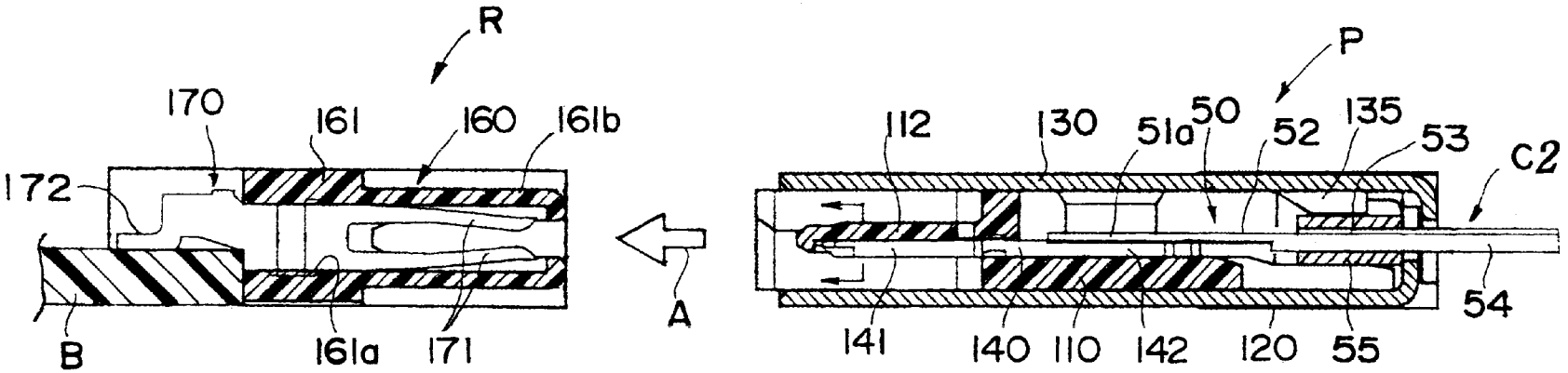
FIG. 12 is a sectional view showing a plug connector P constituting a cable connector according to a second preferred embodiment of the present invention, and a receptacle connector R which fits together with this plug connector P, this view corresponding to a sectional view in the direction of arrows XII—XII in FIG. 13 and arrows XII—XII in FIG. 15.
Figure 13:
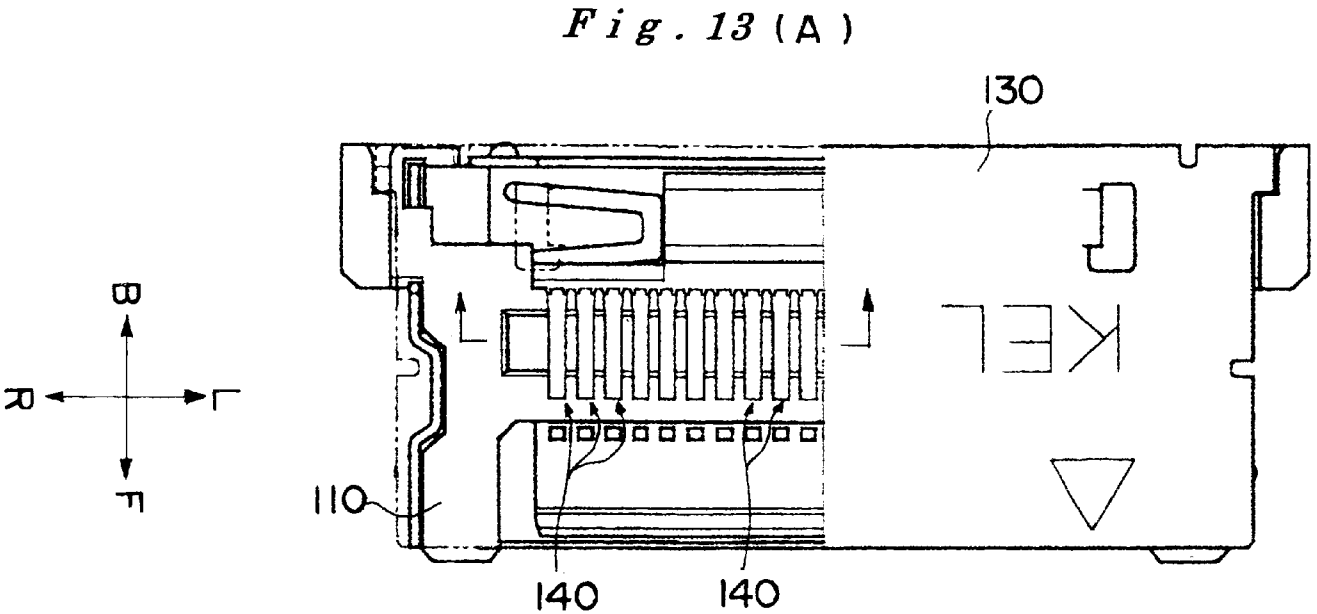
FIGS. 13(A) and (B) are a partial sectional plan view and a front view of the aforementioned plug connector.
Figure 13:
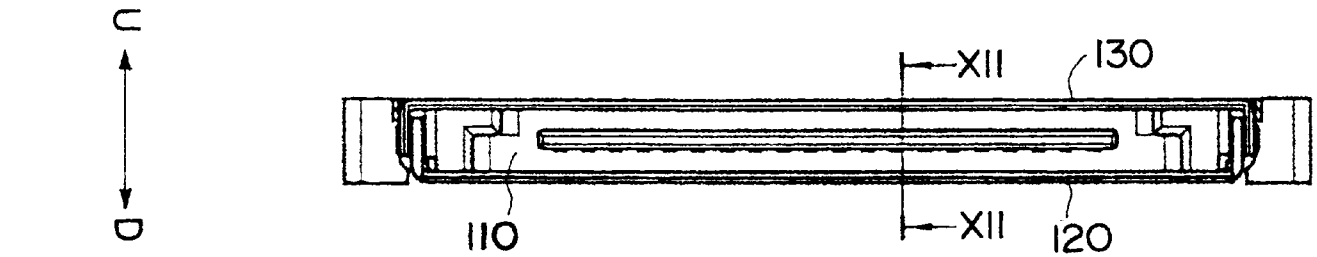
Figure 25:
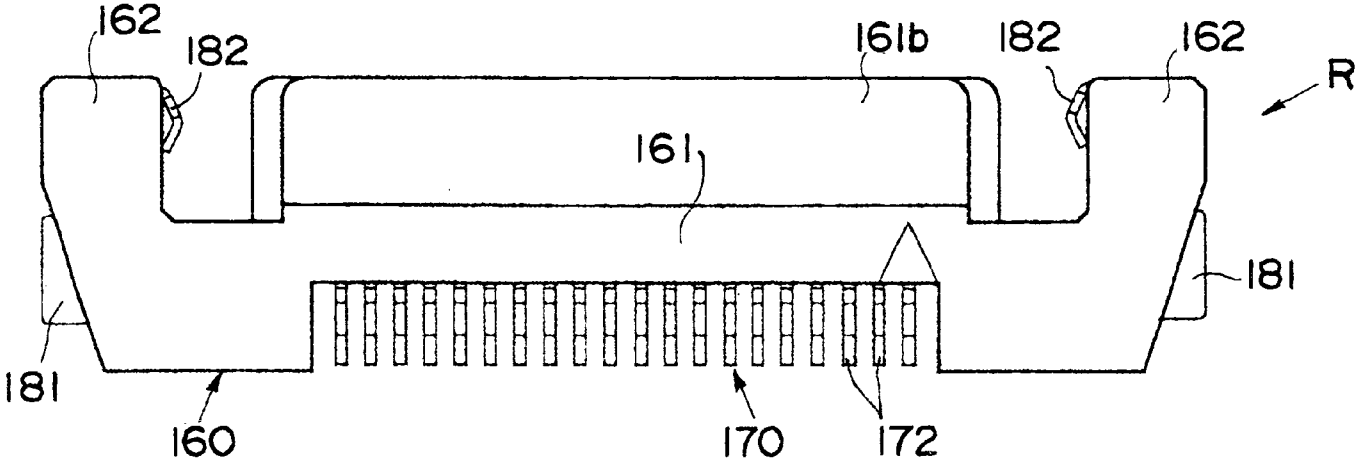
FIGS. 25(A) and (B) are a plan view and side view of a receptacle connector.
Figure 25:
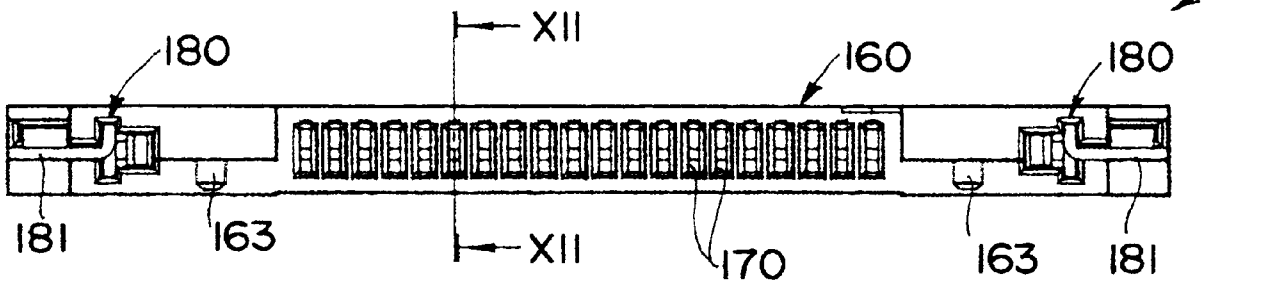
Figure 26E:
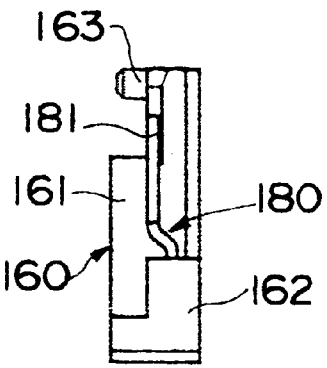
FIGS. 26(C)–(E) are a base view, rear view and side view of a receptacle connector.
Figure 26C:
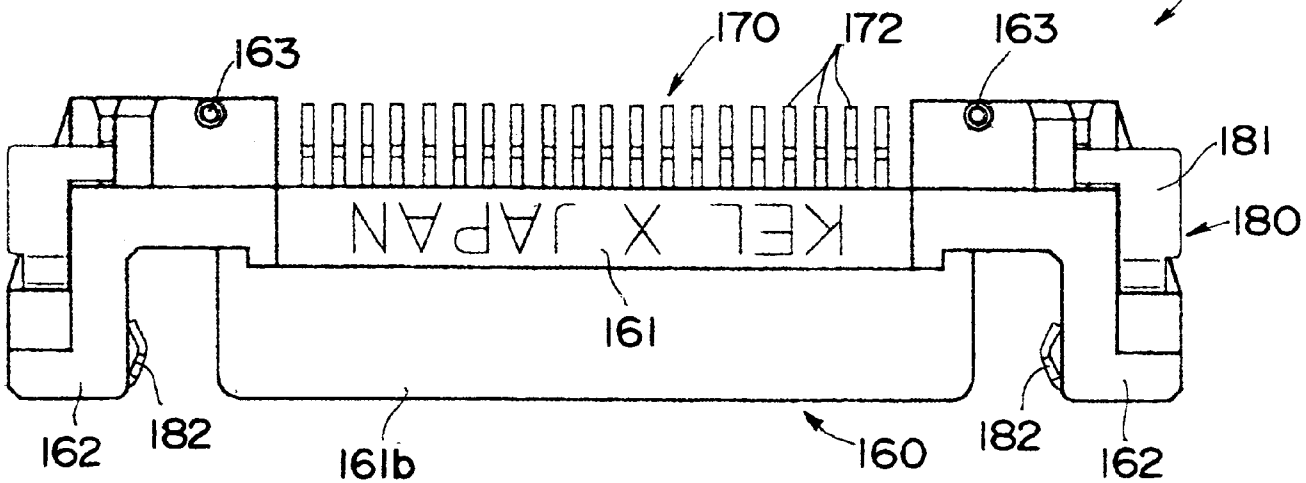
Figure 26D:
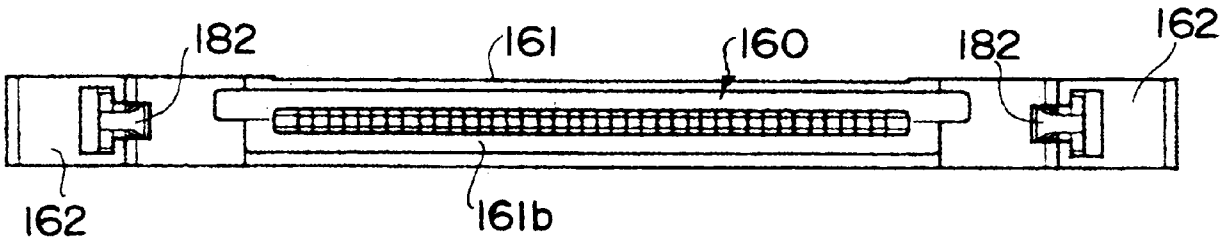

Next, a second preferred embodiment of a cable connector relating to the present invention is described. FIG. 12 shows a mutually interlocking plug connector P and receptacle connector R, wherein the plug connector P constitutes a cable connector relating to the present invention. The plug connector P is illustrated further in FIG. 13 and the receptacle connector R is illustrated in FIG. 25 and FIG. 26. FIG. 12 shows a cross-section in the direction of arrow XII—XII in FIG. 13 and arrow XII—XII in FIG. 15.

The plug connector P comprises: a lower cover 120 and upper cover 130 made from a metal; a plug holding member 110 made from a resin having electrical insulating properties, which is disposed between the aforementioned covers 120, 130; a multiplicity of plug contacts 140 held and fixed in a single flat arrangement by the plug holding member 110; and a cable assembly C2, which although illustrated in a detached state in the drawings, is in fact soldered to the respective plug contacts 140 and extends externally from the rear end side thereof.

Figure 14:
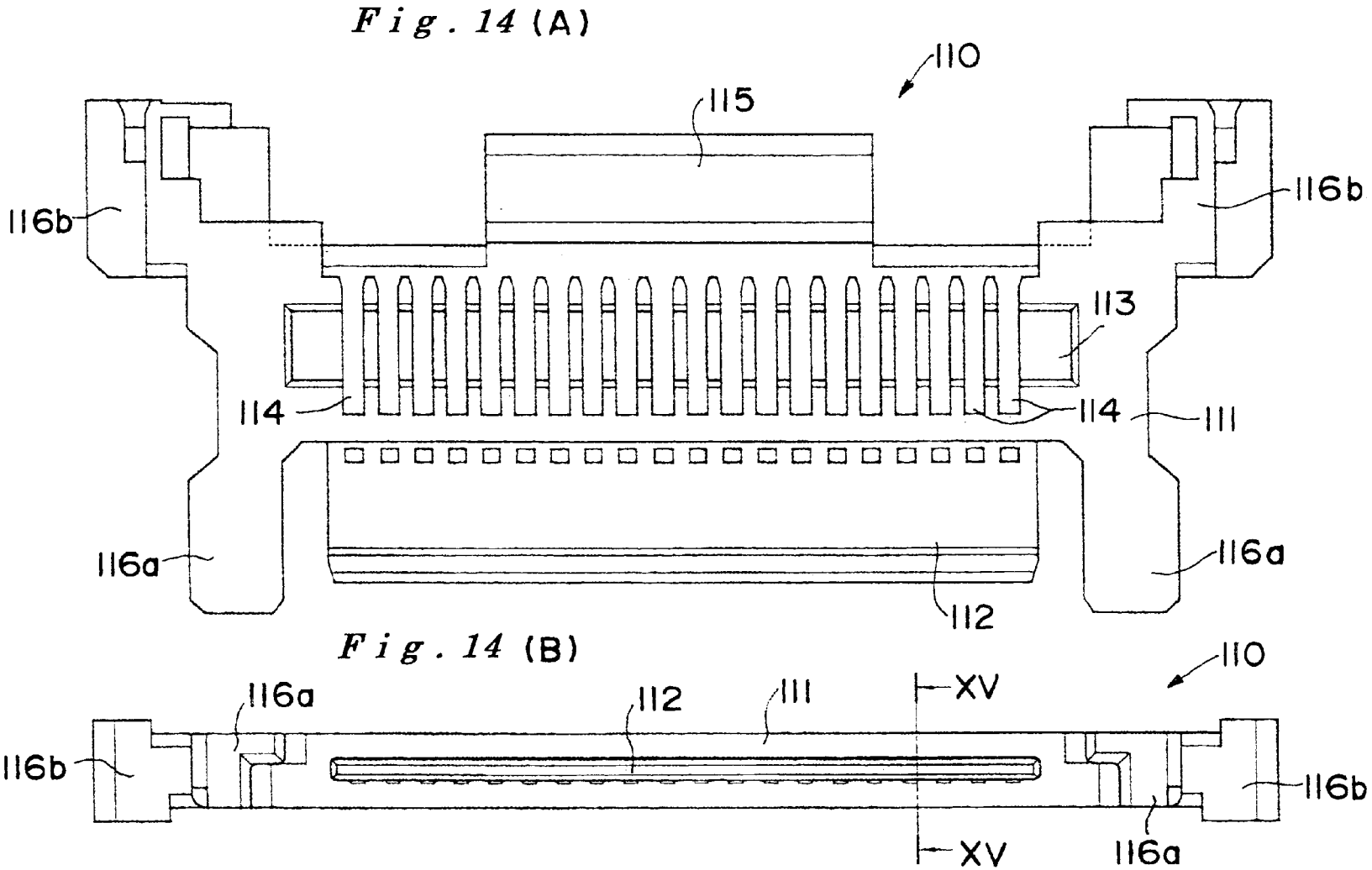
FIGS. 14(A) and (B) are a plan view and front view of a plug holding member in the aforementioned plug connector.
Figure 15:
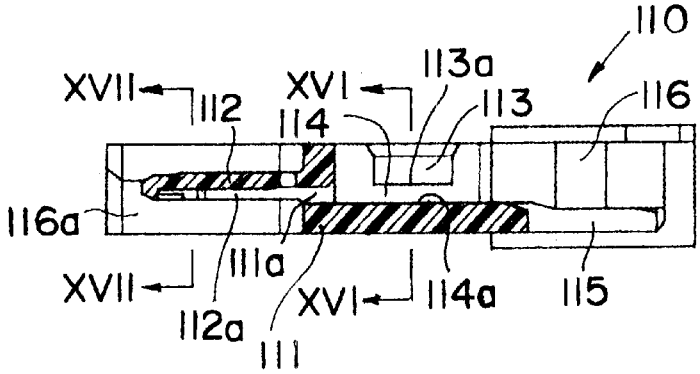
FIG. 15 is a sectional view showing the aforementioned plug holding member, taken in the direction of arrows XV—XV in FIG. 14.

As illustrated in FIG. 14 and FIG. 15, the plug holding member 110 is formed as a single body by resin moulding, or the like, and comprises a body section 111, front left and right projecting sections 116*a* projecting forwards from the front left and right side of the body section 111, and rear left and right projecting sections 116*b* projecting rearwards from the rear left and right thereof. Moreover, a strip-shaped plug projecting section 112 is formed projecting forwards between the front left and right projecting sections 116*a*, and a central projecting section 115 is formed projecting rearwards in the centre of the lower face, between the rear left and right projecting sections 116*b*. Similarly to the foregoing embodiment as indicated by the arrows in FIG. 1, the respective directions indicated by the arrows in FIG. 13(A) are designated as front, back, left and right (F, B, L, R), and the directions indicated by the arrows in FIG. 13(B) are designated as up and down (U, D).

Figure 16:
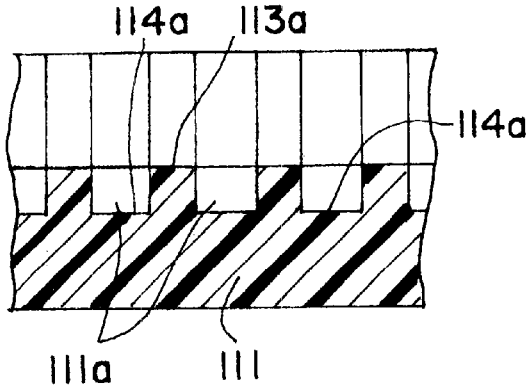
FIG. 16 is a sectional view showing the aforementioned plug holding member, taken in the direction of arrows XVI—XVI in FIG. 15.
Figure 17:
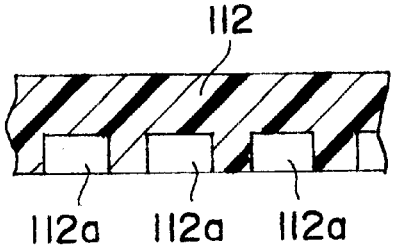
FIG. 17 is a sectional view showing the aforementioned plug holding member, taken in the direction of arrows XVII—XVII in FIG. 15.

A single central groove 113 extending in the left/right direction is formed in the upper face of the body section 111, and moreover, a multiplicity of receiving grooves 114 extending in the front/back direction are formed intersected laterally with this central groove 113. This section is illustrated in FIG. 16 as a section taken in the direction of arrows XVI—XVI in FIG. 15; the receiving grooves 114 are deeper than the central groove 113, such that the base face 114*a* of each receiving groove 114 is positioned below the base face 113*a* of the central groove 113. Therefore, in regions of the central groove 113, the base face thereof 113*a* becomes the surface of a receiving groove 114 (in other words, a plane in which a receiving groove 114 is formed). Moreover, through holes 111*a* having a common base surface with the base face 114*a* of a receiving groove 114 are formed through the body section 111. These through holes 111*a* are formed extending to the plug projecting section 112, and as shown by the section along XVII—XVII in FIG. 15 illustrated in FIG. 17, receiving grooves 112*a* are formed in the lower face of the plug projecting section 112.

Figure 21:
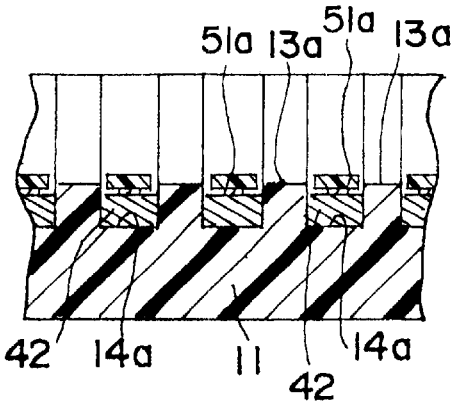
FIG. 21 is a sectional view taken in the direction of arrows XXI—XXI in FIG. 20.
Figure 22:
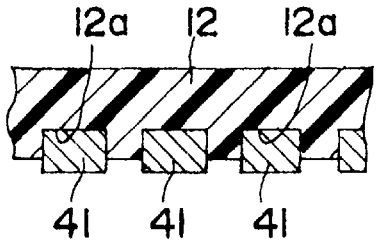
FIG. 22 is a sectional view taken in the direction of arrows XXII—XXII in FIG. 20.

As can be understood from the foregoing description, the receiving grooves 114, through holes 111 and receiving grooves 112*a* extend in a mutually connected fashion in the front/back direction, thereby forming a multiplicity of contact insertion spaces aligned in the right/left direction. The plug contacts 140 are inserted into these respective contact insertion spaces from the rear, and the male contact section 141 on the front end of each plug contact 140 is held inside a receiving groove 112*a*, whilst the connecting section 142 at the rear end of each plug contact 140 is received and held inside a receiving groove 114*a* (see, for example, FIG. 20 to FIG. 22). In particular, as shown in FIG. 22, the male contact sections 141 are received and held inside the receiving grooves 112*a* in the plug projecting section 112, and the plug projecting section 112 serves to support and reinforce the male contact sections 141.

Figure 18C:
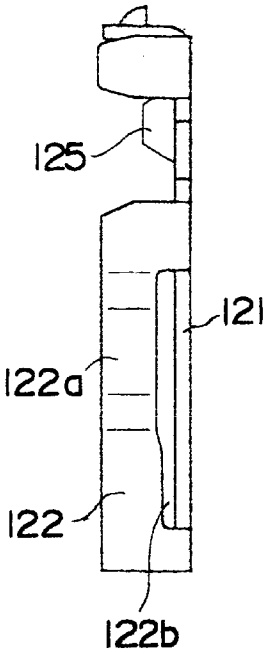
FIGS. 18(A)–(C) is a plan view, front view and side view of a lower cover.
Figure 18A:
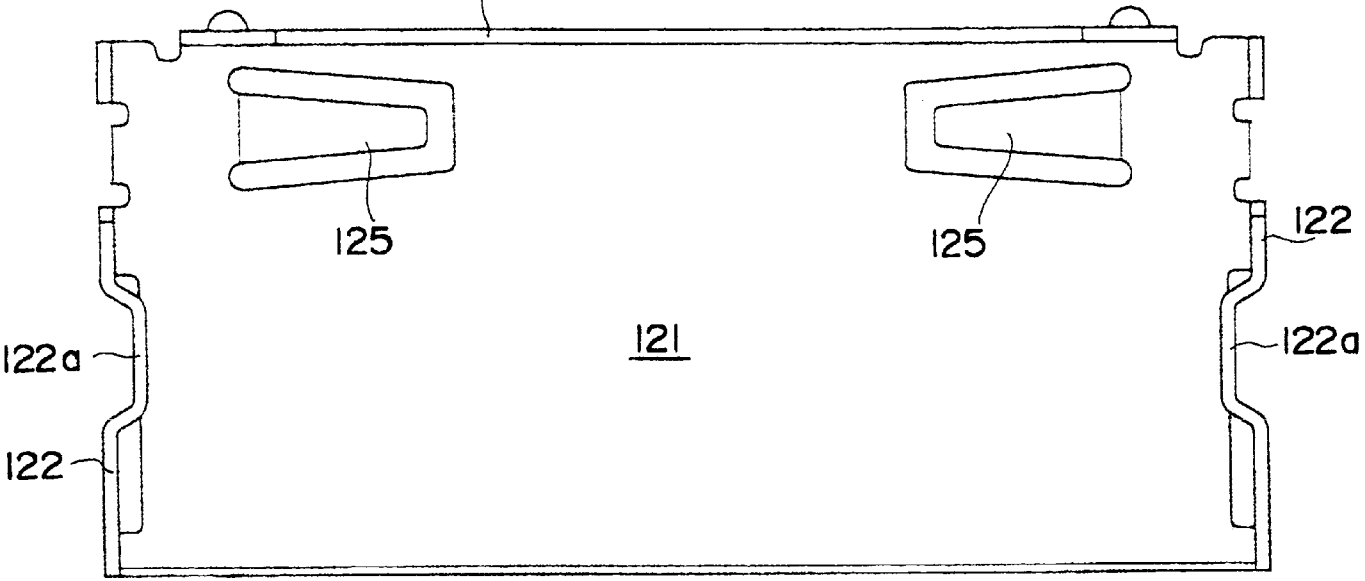
Figure 18B:
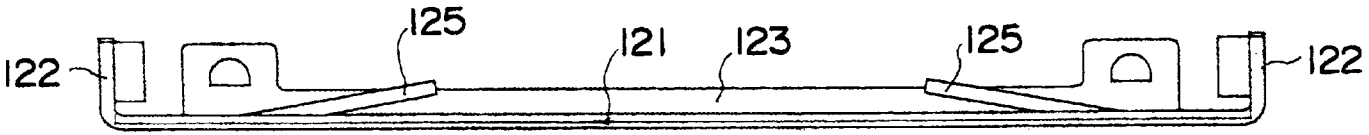
Figure 19:
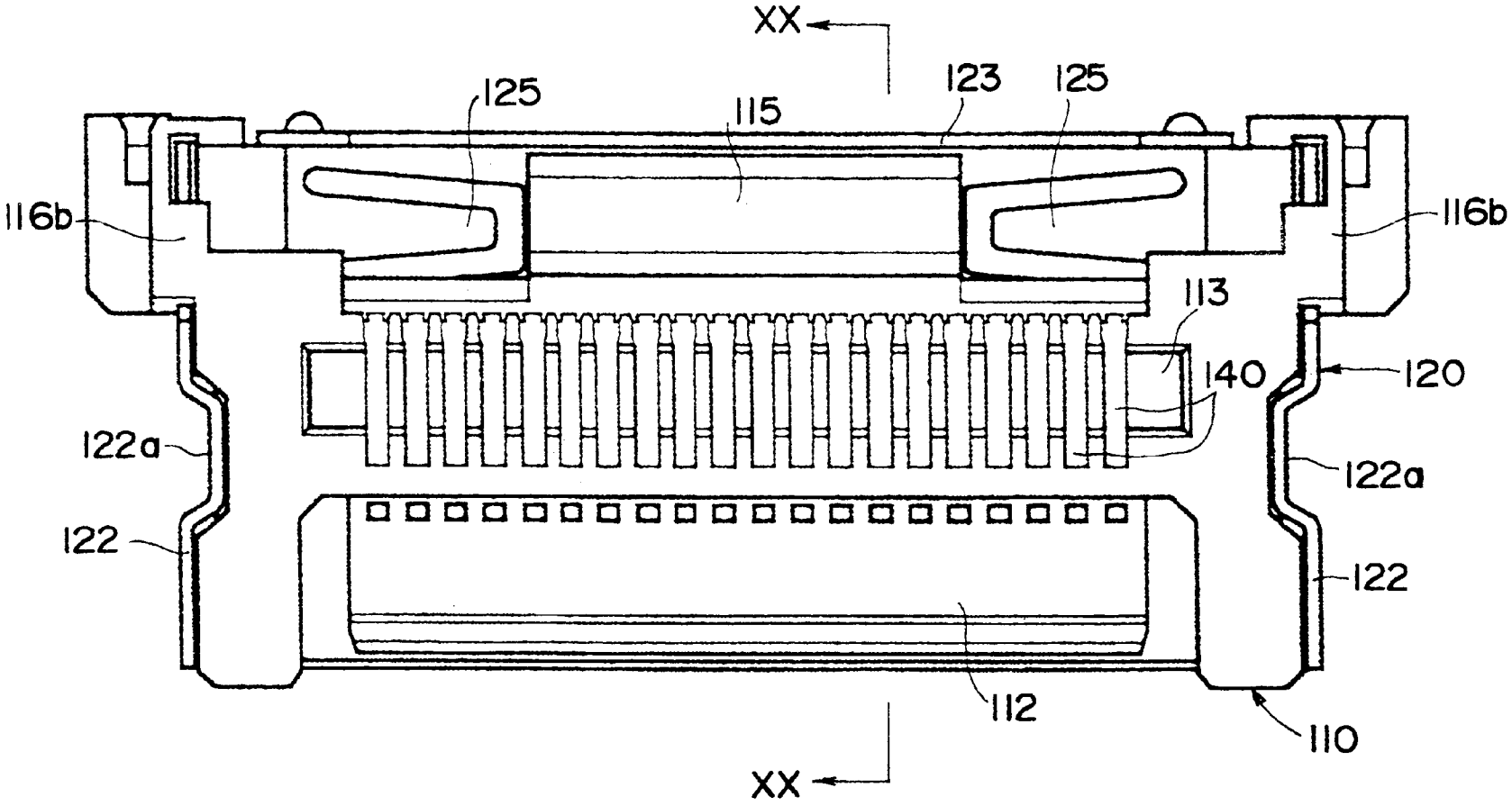
FIG. 19 is a plan view showing a state where the aforementioned plug holding member is mounted in an upper cover.

As shown in FIG. 19, the plug holding member 110 having the foregoing composition (in a state where the plug contacts 140 are push-inserted and held therein) is attached to the top of the lower cover 120 having the shape illustrated in FIG. 18. The lower cover 120 comprises square plate-shaped lower face section 121, which is bent upwards to form left and right side walls 122 and a rear wall 123 rising in the upward direction. A recess section 122*a* bent to the inner side is formed in the left and right-hand side walls 122, and the plug holding member 110 is mounted between the left and right side walls 122 and the rear wall 123. Here, the recess section 122*a* fits together with the side face of the plug holding member 110, and hence serves as a positioning guide. A slot-shaped coupling hole 122*b* extending in the front/back direction is formed in the lower side face of the respective left and right side walls 122.

The left and right-hand sides of the rear portion of the lower face section 121 are cut away and bent obliquely upwards as illustrated in the drawings, to form a pair of left and right contact strips 125. As can be seen from FIG. 19, these contact strips 125 are positioned between the central projecting section 115 of the plug holding member 110 and the rear left and right projecting sections 116*b* thereof, the front ends of these contact strips 125 projecting upwards above the upper face of the central projecting section 115. The front face of the lower cover 120 is open and the plug projecting section 112 borders the open front face thereof.

Figure 20:
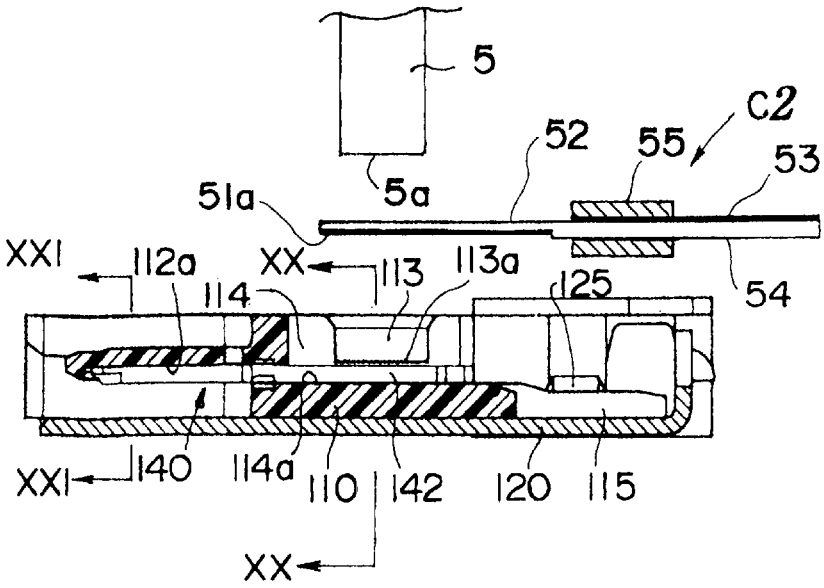
FIG. 20 is a sectional view taken in the direction of arrows XX—XX in FIG. 19.

FIG. 20 shows a sectional view in the direction of arrows XX—XX of a state where the plug holding member 110 is mounted on the lower cover 120 in the foregoing manner. A cable assembly C2 is attached by soldering onto the connecting sections 142 of the plug contacts 140 in the plug holding member 110.

Figure 23B:
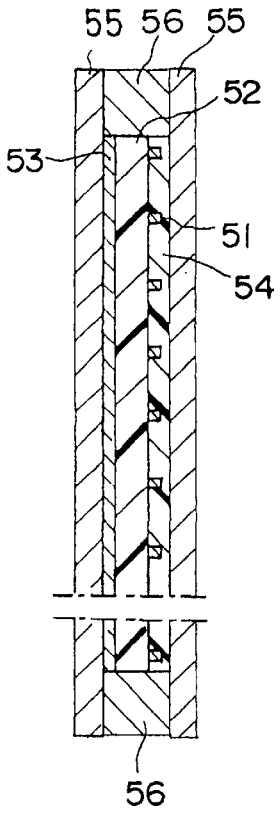
FIGS. 23(A)–(C) show a plan view, rear sectional view and side sectional view showing an FPC cable assembly constituting the aforementioned cable connector.
Figure 23A:
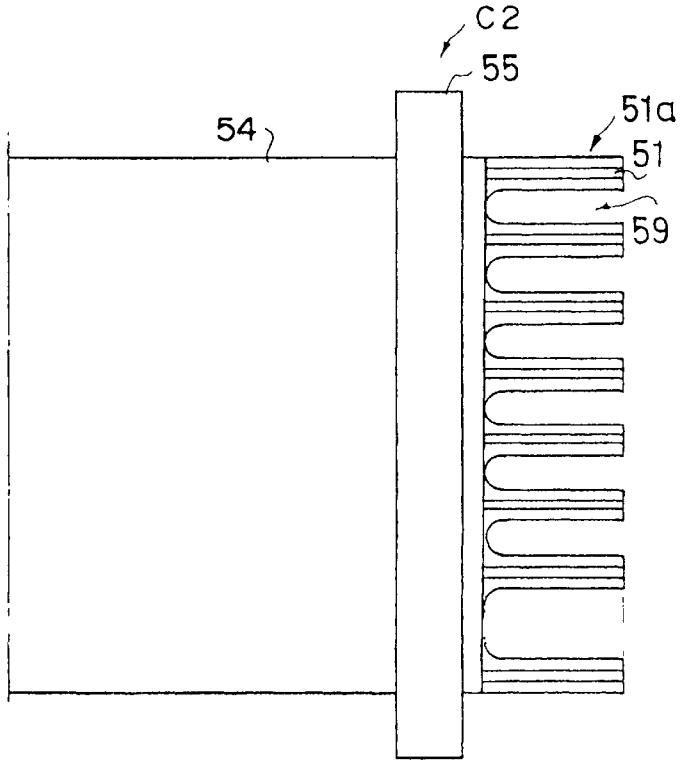
Figure 23C:
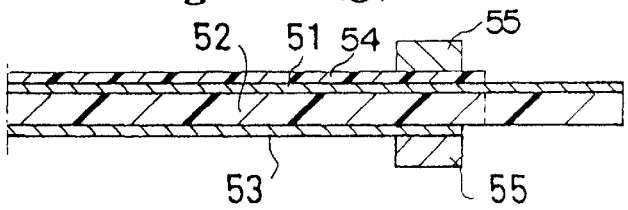

The cable assembly C2 has a similar composition to the cable assembly C1 described in the first embodiment above, and is illustrated in FIG. 23. An insulating cover layer 54 is formed on top of signal circuit layers 51 in the aforementioned FPC cable 50, and ground bars 55 are installed via this insulating cover layer 54 both above and below the FPC cable, the respective end portions thereof being connected by solder 56. Therefore, the upper and lower ground bars 55 are insulated from the signal circuit layers 51 by means of the insulating cover layers 54, and furthermore, being mutually connected electrically by means of the right and left-hand solder junctions, they have the same electric potential as the ground circuit layer 53. Moreover, the insulating cover layers 54 are formed from the ground bars 55 towards the front end, up to a position which is a prescribed insulating distance from the signal circuit layers 51, in such a manner that the plurality of signal circuit layers 51 are exposed at the front end portion of the cable assembly C2. Parts which are the same as the cable assembly C1 have been similarly labelled, and further description thereof is omitted here.

As illustrated in FIG. 20, the cable assembly C2 composed in this manner is soldered by means of a pulse heater. In this solder joining process, firstly, the connection end portions 51*a* at the front end of the cable assembly C2 are aligned with the plug contact receiving grooves 114, whereby the signal circuit layers 51 exposed on the lower face are mounted over the connecting sections 142 of the plug contacts 140 installed in the plug holding member 110 (see FIG. 21 showing a sectional view in the direction of arrows XXI—XXI).

In a state where the core wires 51 are positioned on the contact connection sections 142, the lower face 5*a* of the heater chip 5 of the pulse heater is pressed down on the connecting end sections 51*a*, thereby heating same universally from the rear face thereof. A solder coating is previously formed on the connection end sections of the signal circuits 51, and hence the solder is caused to melt by the heat from the heater chip 5, and the signal circuits 51 are all soldered respectively to the connecting section 142 of the corresponding contact 140, in a single process.

In a state where the signal circuits 51 at the front end of the cable have been soldered to the contact connecting sections 142, the cable assembly C2 is installed in such a manner that the ground bars 55 are positioned at the rear section of the plug holding member 110. In other words, the ground bars 55 are installed covering the central projecting section 115 in the plug holding member 110 mounted on the lower cover 120, and the contact strips 125 formed in the lower cover 120, whilst the lower face of the ground bars 55 confronts and contacts with the contact strips 125.

Figure 24:
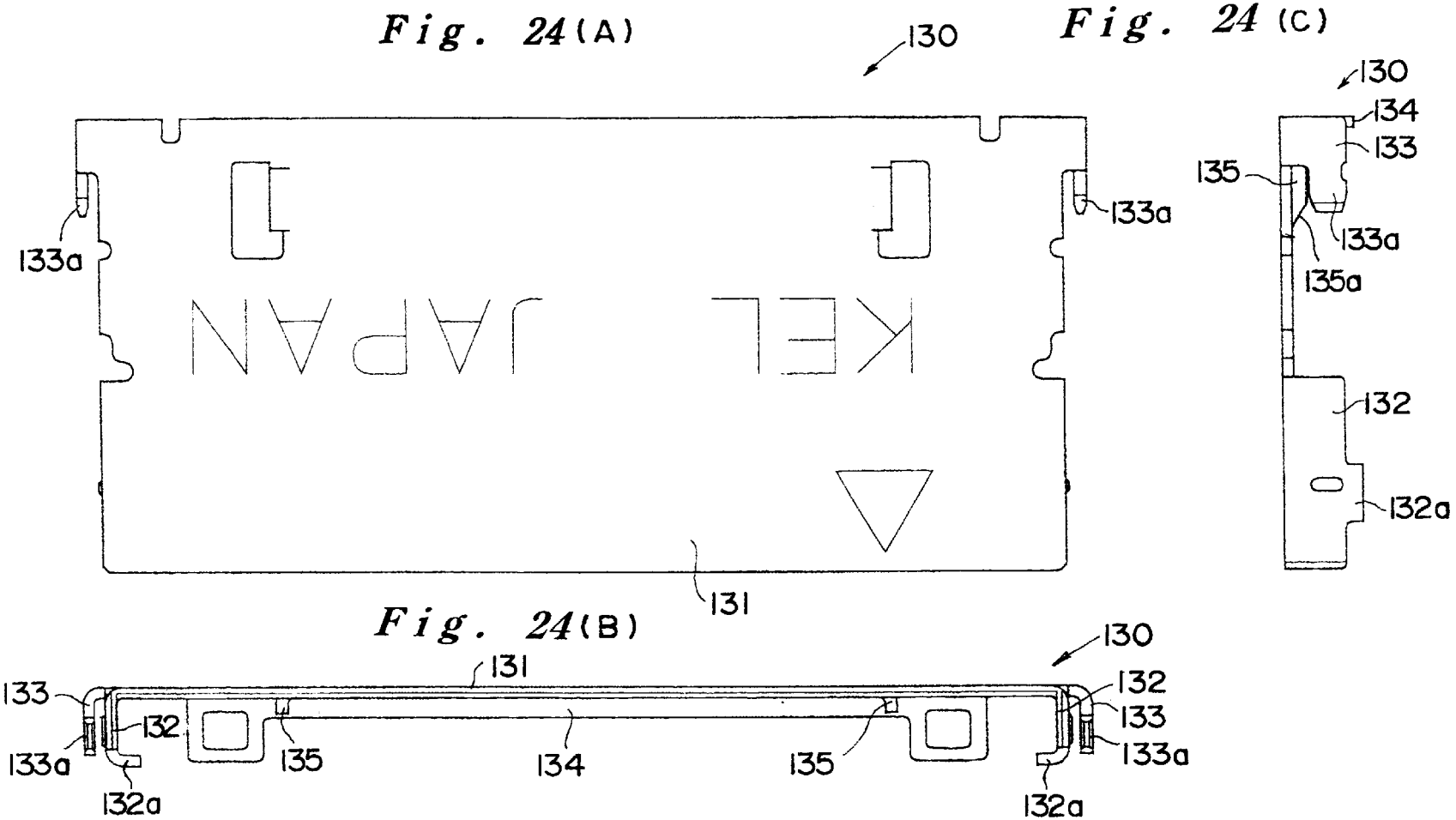
FIGS. 24(A)–(C) show a plan view, front view and side view illustrating an upper cover.

Next, an upper cover 130 having the shape illustrated in FIG. 24 is installed thereon. The upper cover 130 comprises a square plate-shaped upper face section 131, which is bent upwards to form upright left and right front side walls 132, left and right rear side walls 133 and a rear side wall 134. Moreover, engaging sections 132*a* bent towards the inner side are formed in the left and right-hand front side walls 132, and engaging projections 133*a* projecting in a forward direction are formed in the left and right-hand rear side walls 133. Furthermore, the left and right sides of the rear portion of the upper face section 131 are cut away and bent downwards, as illustrated in the drawings, to form pressure insertion projections 135. The front portions of these pressure insertion projections 135 have a tapered surface 135*a* towards the rear.

The upper cover 130 is placed over the lower cover 120 (and the plug holding member and case assembly C2, etc. mounted therein), the left and right front side walls 32 passing the outer sides of the recess sections 22*a* in the lower cover 120, and it is then slid forwards. As a result, the engaging sections 132*a* of the left and right front side walls 132 enter inside the engaging holes 122*b* formed in the left and right side walls 122 of the lower cover 120 illustrated in FIG. 18, thereby coupling the two covers 120, 130 together. At the same time, the engaging projections 133*a* on the left and right rear side walls 133 enter into engaging holes (not illustrated) formed in the rear face of the plug holding member 110, thereby coupling the upper cover 130 and the plug holding member 110. Moreover, in this operation, the pressure insertion projections 135 rise up over the ground bars 55 along the tapered surfaces 135*a*, and hence press downwards on the ground bars 55. Consequently, in addition to abutting against and contacting with the pressure insertion projections 135, the ground bars 55 also securely abut against and contact with the contact strips 125 of the lower cover 120. A plug connector P is constituted by the foregoing.

On the other hand, the external appearance of a receptacle connector R is illustrated in FIG. 25 and FIG. 26, and moreover, as shown by the sectional view in FIG. 12 taken in the direction of arrows XII—XII in FIG. 25, this receptacle connector R is constituted by pushing and holding in an arrayed fashion a multiplicity of receptacle contacts 170 made from conductive material into a receptacle holding member 160 made from an insulating material. The receptacle contacts 170 are tuning fork-shaped contacts, comprising a female contact section 171 having a bifurcated shape at the front end section thereof, and a surface mount lead 172 provided at the rear end section thereof.

The receptacle holding member 160 is formed by resin moulding, or the like, and comprises a body section 161 wherein pressure insertion holes 161*a* into which receptacle contacts 170 are pushed and held are formed in an alignment in the left/right direction, and arm sections 162 formed at the left and right of the body section 161. A projecting section 161*b* projecting in the forward direction is formed between the arm sections 162, and the pressure insertion holes 161*a* are open to the front via this projecting section 161*b*. Therefore, the female contact sections 171 of the receptacle contacts 170 push inserted into the pressure insertion holes 161*a* face outwards in the forward direction via these openings. Ground members 180 are respectively pushed into and held by the left and right arm sections 162, and these ground members 180 each comprise a ground contact section 182 projecting from the inner side face of the arm section 162 towards the projecting section 161*b*, and a mount section 181 projecting to the rear side of the arm section 162. Moreover, the lower face of the mount section 181 is positioned in the same plane as the lower face of the lead 172 of the receptacle contacts 170.

A pair of positioning projections 163 are formed in lower rear face of the receptacle holding member 160, the receptacle connector R being located in position by means of these positioning projections 163 when installed on top of a printed circuit board B, as illustrated in FIG. 12. Here, the leads 172 for the respective receptacle contacts and the lower face of the mount section 181 are respectively coupled by surface mounting to a signal pattern and ground pattern on the printed circuit board B.

A plug connector P and receptacle connector R having the foregoing compositions can be fitted together and connected as illustrated by arrow A in FIG. 12. Here, with the plug connector P in a state where the male contact sections 141 of the plug contacts 140 are accommodated and held in the receiving grooves 112*a*, the plug projecting section 112 is inserted into the female contact sections 171 of the receptacle contacts 170 in the receptacle connector R. Consequently, the female contact sections 171 hold the plug projecting section 112 and the male contact sections 141 on either side thereof, whereby the female contact sections 171 and the male contact sections 141 abut against and contact with each other, and hence the sets of contacts 140, 170 are electrically connected. Here, the plug contacts 140 are fine wire-shaped members, but since they are inserted into the female contact sections 171 together with the plug projecting section 112, in a state where they are supported and reinforced by this planar shaped plug projecting section 112, there is no risk of deformation of the contacts 140.

Moreover, if the two connectors P, R are fitted together and connected in the aforementioned manner, the front left and right projecting sections 116*a* in the plug holding member 110 which is surrounded by the upper and lower covers 120, 130 in the plug connector P, will be inserted respectively between the right and left arm sections 161 and the projecting section 161*b* in the receptacle connector R, and the outer side face of the upper cover 130 will confront and contact with the ground contact sections 182 of the ground members 180. Here, the mount sections 181 of the ground members 180 are grounded by surface mounting to a ground pattern on the printed circuit board B, and therefore, the upper and lower covers 120, 130 are grounded. Moreover, the ground bars 55 of the cable assembly C2 are held on either side by the upper and lower covers 120, 130, such that they confront and contact same, and hence the ground circuit layer 53 of the FPC cable 50 is grounded. Thereby, the upper and lower covers 120, 130 provide a shielding action, which prevents infiltration of external noise or external dissipation of noise by the connector.

In the present embodiment, a composition is adopted wherein U-shaped grooves 59 are provided at the front end section of the FPC cable 50, but in the present invention, it is also possible to adopt a composition wherein such grooves, or slits, are not provided. As revealed by the sectional view shown in FIG. 21, this can be explained by the relationship between the depth of the receiving grooves 114 (vertical dimension from the surface of the receiving grooves 114, in other words, the base face 113*a* of the central groove 113, to the base face 114*a* of the receiving grooves 114) and the vertical thickness of the contact connecting sections 142.

For example, by making the conducting layer of the signal circuits 51 thicker in FIG. 21, it is possible to adopt a composition whereby, in a soldered and coupled state, the base surface of the circuit substrate 52, is located above the base surface 113*a* of the central groove 113 (in other words, a clearance is provided). Alternatively, it is possible to constitute the central groove 113 in such a manner that the connecting sections 142 of the plug contacts project upwards above the base surface 113*a* of the central groove 113. By adopting a composition of this kind, it is also possible to adopt a composition which dispenses with the aforementioned U-shaped grooves 59 (for example, a flat composition, or a composition comprising slits only,) without the front end section of the FPC cable 50 entering inside the receiving grooves 114.

Moreover, by means of a cable connector as described above, it is possible to achieve a composition which maintains compatibility between a cable assembly using an FPC cable 50 and a cable assembly using ultra-fine coaxial cables. Therefore, it is possible to provide an optimum cable assembly according to the relevant application.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This application claims the priority of Japanese Patent Application No. 11-326888 filed on Nov. 17, 1999, which is incorporated herein by reference.

What is claimed is:

1. A cable connector comprising a plurality of contacts which are arrayed and held in a lateral direction inside a housing and a cable with a front end portion having a first connecting section which is connected to said contacts and a rear portion which extends externally from said housing;

wherein a shield cover is attached to said housing, covering at least a portion of an outer face thereof;

said cable comprises a plurality of signal conducting layers formed onto one surface of a sheet of insulating material and a ground conducting layer formed onto another surface thereof, opposite the one surface; and a ground bar made from a conductive material is integrally joined by soldering to said ground conducting layer to extend in the lateral direction across a top of a front end section of said ground conducting layer in a second connecting section of the cable, said ground bar abutting with said shield cover so that said ground conducting layer is connected to said shield cover by said ground bar, front end portions of said plurality of signal conducting layers in the first connecting section being connected, respectively, to corresponding contacts of said plurality of contacts and the connecting sections between said signal conducting layers and said contacts at the front end of said cable are separated into a band shape for each of said plurality of signal conducting layers.

2. The cable connector according to claim 1, wherein said ground conducting layer is formed covering said one surface of said rear portion of said sheet, excluding the first connecting section.

3. The cable connector according to claim 1, wherein the one surface of said sheet material on which said ground layer has been formed is covered with an insulating layer except in the second connecting section;

and said another surface of said shield material on which said plurality of signal conducting layers have been formed is covered with an insulating layer except in the first connecting section.

4. The cable connector according to claim 3, wherein a ground layer is formed over said insulating layer formed covering said another surface of said sheet material whereon said plurality of signal conducting layers are formed.

5. The cable connector according to claim 1, wherein the connecting sections between said signal conducting layers and said contacts at the front end of said cable are divided into a band shape for each of said plurality of signal conducting layers, by means of a plurality of U-shaped grooves formed extending in a longitudinal direction at the front end portion of said cable.

6. The cable connector according to claim 1, wherein the connecting sections between said signal conducting layers and said contacts are divided into a band shape for each of said plurality of signal conducting layers, by means of a plurality of slits formed extending in a longitudinal direction at the front end portion of said cable.

7. The cable connector according to claim 1, wherein the ground bar abuts with the shield cover by engagement of the ground bar with detent means formed on the shield cover.

8. The cable connector according to claim 1, wherein said front end portions of the signal conductors are connected, respectively, to corresponding contacts of said plurality of contacts by a single soldering step.

9. The cable connector according to claim 1, wherein the surface of the sheet of insulating material signal on which the conductive layers are formed is adjacent the contacts.

* * * * *